United States Patent [19]

Olsson

[11] 4,244,044

[45] Jan. 6, 1981

[54] WATERPROOF SPORT WATCH

[76] Inventor: Mark S. Olsson, 450 A Serpentine Dr., Del Mar, Calif. 92014

[21] Appl. No.: 72,053

[22] Filed: Sep. 4, 1979

[51] Int. Cl.[3] ..... G04B 37/00

[52] U.S. Cl. ..... 368/291; 368/224; 368/289; 368/294

[58] Field of Search ..... 58/23 R, 50 R, 88 R, 58/90 R, 53–56, 23 BA; 368/224, 294, 291, 289

[56] References Cited

U.S. PATENT DOCUMENTS

| | | | |
|---|---|---|---|
| 3,255,319 | 6/1966 | Paine | 200/302 X |
| 3,545,198 | 12/1970 | Loftus | 58/90 R |
| 3,975,899 | 8/1976 | Haber | 368/224 X |
| 4,038,814 | 8/1979 | Niida | 368/291 X |
| 4,048,796 | 9/1977 | Sasaki | 368/224 |
| 4,051,665 | 10/1977 | Arn | 58/23 BA X |
| 4,170,104 | 10/1979 | Yamagata | 368/289 |
| 4,178,751 | 12/1979 | Liautaud | 58/23 BA |
| 4,184,321 | 1/1980 | Tarusawa | 200/302 X |

*Primary Examiner*—Ulysses Weldon
*Attorney, Agent, or Firm*—Brown & Martin

[57] ABSTRACT

A waterproof sport watch utilizing a solid state digital watch module which is completely enclosed in a sealed casing, with no protruding buttons or other actuating devices. The module is fixed in a casing having a removable back, sealed by an O-ring, for battery and servicing access. The front of the watch is enclosed by a transparent cover, also sealed by an O-ring, the cover being rotatable to indexed positions and having integral cams which actuate the watch module controls, a stopwatch action being obtained by squeezing the cover at one indexed position. The watch is particularly suitable for use by divers and is very easy to operate under water.

10 Claims, 6 Drawing Figures

WATERPROOF SPORT WATCH

BACKGROUND OF THE INVENTION

Watches are usually waterproofed by having tightly fitting casing components, with seals where necessary, and a seal around any protruding part such as a stem or winder. While this is sufficient to most purposes, underwater use requires more elaborate procedures. Underwater watches are usually enclosed in a sealed container, with protruding elements separately sealed or enclosed in a flexible or resilient boot.

Solid state digital watches have not been considered particularly suitable for underwater use, since their operating controls usually include from one to three very small push buttons and a recessed setting button. Any sealed enclosure would have to include access or operating connections to the various buttons, which could be easily operated underwater. This is particularly necessary for a diver, since a stopwatch function is often used to time a dive or air supply.

SUMMARY OF THE INVENTION

The watch described herein uses a solid state digital watch module in a special sealed case of simple design, which eliminates all protruding controls. The watch module can be a standard type readily available from several manufacturers, or could be adapted to the purpose by very simple modifications. A simple rigid case holds the watch module securely and has a removable back plate, sealed by an O-ring, for battery replacement and servicing access.

A transparent cover is sealed to the front of the casing by an O-ring, which allows the cover to be rotated and also depressed very slightly. The watch controls are actuated by rotating the cover to various indexed positions, the indexing means being visible through the transparent cover.

The basic watch module has electrical contacts recessed in peripheral notches, the push buttons of the conventional watch being positioned to complete circuits to the contacts selectively. In the waterproof watch a ground plane element, which is connected to one side of the battery, has integral contact fingers positioned to engage the existing contacts in the module. Actuating means in the rotating cover engages each finger selectively to make the required contact. In a preferred form the actuating means comprises cams which engage the contacts through movable actuating elements.

The usual mode change, stop-start and setting functions are operated at specific positions of the cover. To facilitate stopwatch action, the cams have one position in which the stop-start contact finger is partially moved toward the module contact. The stop and start actions can then be controlled by squeezing the cover, the O-ring seal and the internal clearance of the cover from the case being designed to allow a sufficient limited movement for this purpose. This type of control is very easy to operate under water and even when wearing gloves.

The primary object of this invention, therefore, is to provide a new and improved waterproof sport watch.

Another object of this invention is to provide a waterpoof watch which is completely sealed and has no external controls.

Another object of this invention is to provide a waterproof watch which is controlled by selective rotation and depression of a transparent front cover.

A further object of this invention is to provide a waterproof watch which is adaptable to a conventional solid state digital watch module.

Other objects and advantages will be apparent in the following detailed description, taken in conjunction with the accompanying drawing, in which.

DESCRIPTION OF THE PREFERRED EMBODIMENT

Figure 1:
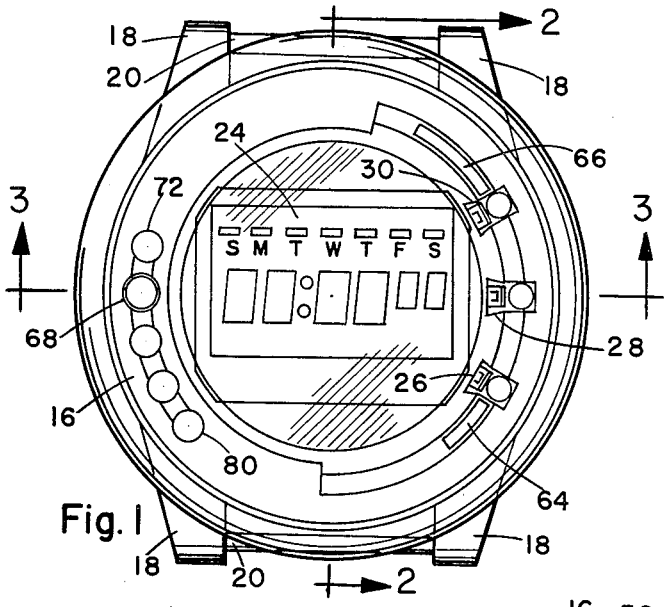
FIG. 1 is a top plan view of a preferred form of the watch.

The watch comprises, basically, a case 10 (FIG. 3) which holds the solid state digital watch module 12 (FIG. 2), a back plate 14 and a cover 16. As illustrated, the case 10 has pairs of lugs 18 (FIG. 1) projecting from both ends, with pins 20 extending between the lugs of each pair to hold the ends of a watch band, not shown. Any suitable means for securing a band or strap to the watch may be used. The module 12 shown is a particular type which is readily available, the watch being adaptable to various types of existing modules.

Figure 2:
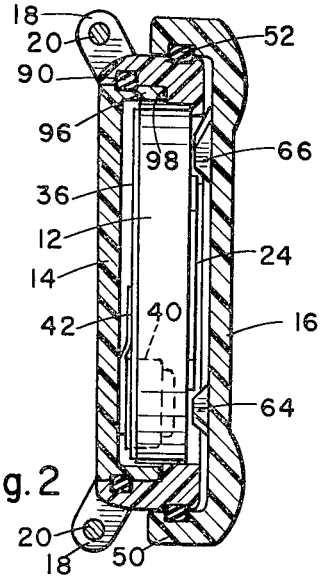
FIG. 2 is a sectional view taken on line 2—2 of FIG. 1.

Base 10 has a cavity 22 (FIG. 3) in which the module 12 is a tight fit, the cavity being shaped as necessary to prevent the module from rotating. Most modules have some non-circular portion, notch, or other such deformation which can be used as a key for this purpose. The module has a display panel 24 (FIG. 1), on which the hours, minutes, seconds, day of the week and date are selectively displayed and the arrangement and number of functions may vary. Module 12 is shown as having three switch positions for mode 26, set 28 and stopstart 30 (FIG. 1). Some watch modules have only two switches for mode and set, while others may have additional switches for event timing and the like. The switches can be on one side, as shown, or distributed on both sides. It will become apparent that the watch can accommodate all commonly used types of existing modules. At each switch position a conductive contact 32 is positioned on the side of the module, usually in a recessed notch 34 as in FIGS. 3–5. In a conventional digital watch the external control button engages this contact when depressed, the control button either operating a switch element or being directly connected to ground or one side of the battery to complete the circuit.

Figure 3:
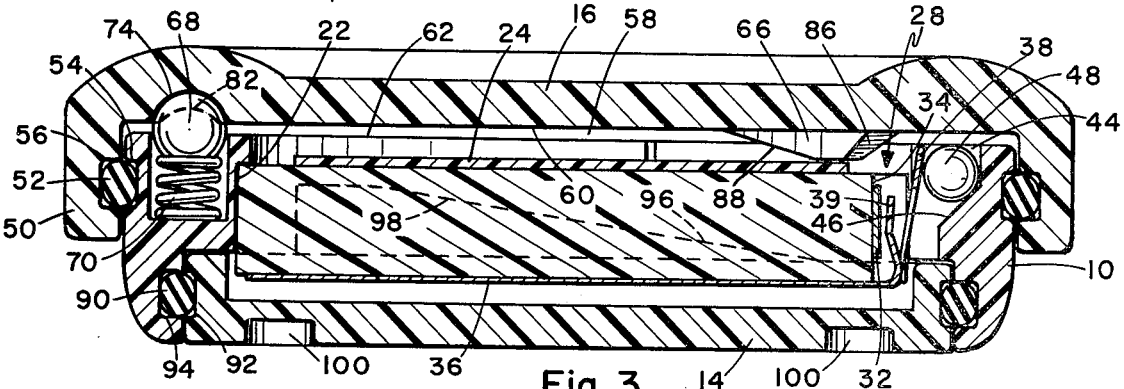
FIG. 3 is an enlarged sectional view taken on line 3—3 of FIG. 1.
Figure 4:
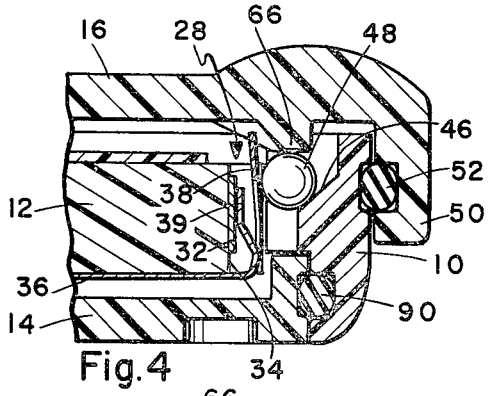
FIG. 4 is a sectional view similar to a portion of FIG. 3, showing the cam action making a contact.
Figure 5:
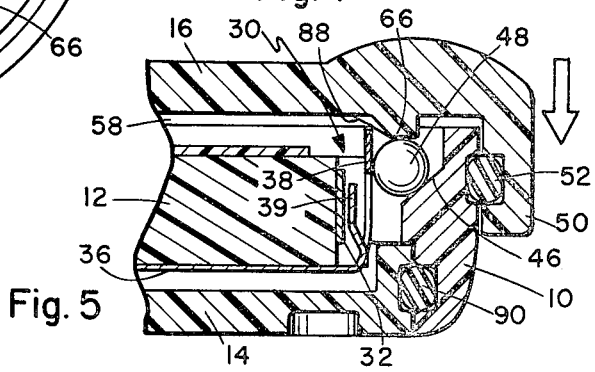
FIG. 5 is a sectional view similar to FIG. 4, but at a different switch position to show the stopwatch action by depressing the cover.

To adapt the module to the waterproof structure, a thin conductive ground plane 36 (FIG. 3) is attached to the back of the module and has integral resilient fingers at each switch position to provide switch elements 38. Each switch element 38 extends upwardly through a notch 34 and is resiliently biased outwardly clear of the contact 32 on the module. The exact configuration of the switch element can vary to suit the module and may include an extended leaf 39, as shown, for most effective contact. One socket, contact and switch arrangement is shown in FIGS. 3 and 4 and is typical of all the switch positions. The battry 40 (FIG. 2) is recessed in the back of the module 12 and is held in place by a ground contact 42. In this arrangement the ground contact 42 is electrically connected to ground plane 36, so that the switch elements 38 are all at ground potential. Some watches have two batteries and the particular configuration may vary.

Base 10 has a plurality of sockets 44 (FIG. 3) in its inner periphery, corresponding to and aligned with the notches 34 at the several switch positions. Each socket has a downwardly and inwardly inclined ramp 46 on which rests an actuating element or ball 48 bearing against the associated switch element. It will be seen that when an actuating ball 48 is depressed it will ride down the ramp 46 and force the switch element 39 against the contact 32, as in FIG. 4. A roller or other such element could be used in place of the ball, but the ball is particularly adaptable to the method of actuation used.

Cover 16 (FIGS. 1 and 3) is of transparent material to reveal the display panel 24 and is preferably molded in one piece to avoid sealing problems. The cover has a deep peripheral flange 50 (FIG. 3) which fits closely around the case 10 and is sealed to the case by an O-ring 52 seated in corresponding grooves 54 and 56 in the case and cover respectively. In the sealed position there is a small gap 58 between the inner face 60 to cover 16 and the top rim 62 of case 10. The O-ring 52 is preferably of silicone rubber or the like, with a Shore hardness of about 40–60, which will allow the cover to be rotated on the case and also be depressed slightly, as allowed by gap 58.

Figure 6:
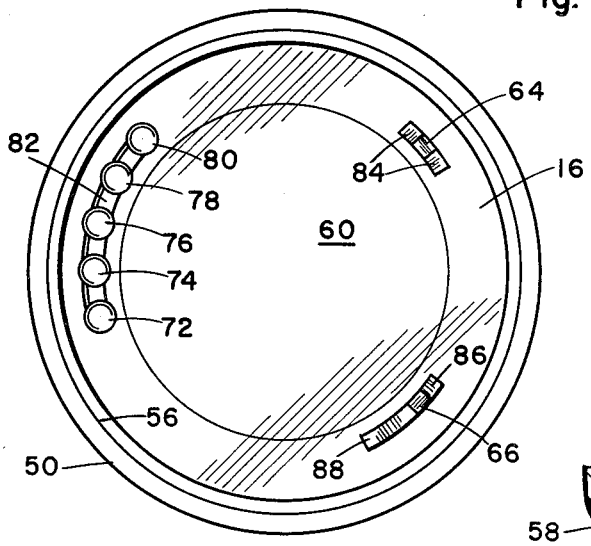
FIG. 6 is an underside view of the cover.

Projecting from the inner face 60 of the cover are circumferentially extending cams 64 and 66 (FIGS. 2 and 3), aligned to engage the actuating balls 48 in turn as the cover is rotated. Base 10 contains a detent ball 68 biased upwardly by a spring 70 to engage one of a plurality of detent sockets in the cover 16. For the three switch module shown, five such sockets 72, 74, 76, 78 and 80 (FIG. 6) are required and are connected circumferentially by a shallow channel 82. Spring 70 is dimensioned so that the detent ball 68 can be depressed enough to ride along channel 82, but cannot be depressed sufficiently to pass under inner face 60. Thus the cover cannot inadvertently be rotated beyond the index limits of the end sockets 72 and 80.

In the normal running position of the watch, detent ball 68 (FIG. 3) is seated in socket 74. In this position, cam 64 (FIGS. 2 and 6) is just clear of mode switch 26 and cam 66 is clear of stop-start switch 30 on the opposite side. Cam 64 operates only the mode switch 26 when the cover 16 is indexed to socket 72, and both sides of the cam have inclined faces 84 to ride over the actuating ball 48 at that switch position.

Cam 66 (FIG. 3) has a short inclined leading face 86 and an elongated inclined trailing face 88. When the cover is indexed all the way to socket 80, cam 66 is depressing actuating ball 48 and closing the switch contacts at the set switch position, as in FIG. 4. With the cover indexed to socket 76 the actuating ball at the stop-start switch 30 is fully depressed in the manner shown in FIG. 4. The action of cam 64 at the mode switch position 26 is also similar When cover 16 is indexed to socket 78, however, a stopwatch action can be obtained, as in FIG. 5. In this position the trailing face 88 of cam 66 is over the stop-start switch 30 and actuating ball 48 is not fully depressed. Switch element 38 is thus partially deflected but leaf 39 is not quite engaging contact 32. Contact is made to start and stop the watch as required by depressing cover 16, as indicated by the directional arrow. Gap 58 provides enough clearance for the partially engaged cam to finish depressing actuating ball 48 and close the switch. The set function may similarly be activated. requiring both proper indexing and depression of cover 16 and thus acting as a safety interlock preventing accidental resetting of the watch.

Back plate 14 (FIG. 3) is held in place and sealed by an O-ring 90 seated in grooves 92 and 94 in the case 10 and back plate, respectively. The O-ring 90 can be of silicone rubber or the like, with a Shore hardness of about 85 for a firm seal.

To facilitate removal of the back plate 14, the periphery has circumferential ramp cams 96 (FIGS. 2 and 3) which seat in corresponding ramp channels 98 in the case 10. The rear face of back plate 14 is provided with sockets 100 (FIG. 3) to receive a spanner wrench, by which the back plate can be rotated. The rotation causes ram cams 96 to ride out of channels 98 and force the back plate axially out of casing 10, snapping over the O-ring 90. Other arrangements for securing and removing the back plate could also be used.

The watch is thus completely waterproof and is particularly suitable for use by divers. The digital display is easy to read under water and gives a precise record of diving time, air supply limits and the like. All functions are controlled by moving the cover, which can be made large, or externally shaped or treated for ease of handling. The transparency of the cover clearly reveals the watch display and also the indexing means, which can be marked or coded in any suitable manner to indicate the functions.

It should be noted that the actuating ball arrangement is adapted to the particular type of watch module having contacts recessed on the side. If the contacts are on the top face of the module, or in some other such position, the cams could operate switch elements directly. In a watch having contacts on both sides, or distributed around the module, it will be obvious that the indexing means can be relocated to suit the contact and cam arrangement. With the O-ring seal and the peripheral gap between the inside of the cover and the case, the cover can be depressed at any position to obtain the stopwatch action.

Having described my invention, I now claim:

1. A waterproof watch, comprising:

a case;

a solid state digital watch module fixed in said case, the module having a plurality of spaced, function initiating contacts thereon, and a data display panel on a front surface thereof;

a front cover rotatably mounted on and sealed to said case, at least a portion of said cover being transparent and revealing said display panel;

said module having contact engaging electrical switch means thereon at the position of each contact on said module;

said cover having actuating means for actuating said switch means selectively at specific rotational positions of the cover;

and said case having indexing means therein engaging said cover to index the cover to the specific switch actuating positions.

2. A waterproof watch according to claim 1, wherein said switch means includes a resilient conductive finger element spaced from and biased away from each of said contacts;

said actuating means including at least one cam for actuating each finger element individually and closing the circuit with the respective contact.

3. A waterproof watch according to claim 2, wherein said case has a socket therein at each contact position, the socket having a downwardly and inwardly inclined ramp, and an actuating element supported on the ramp and engaging the finger element;

said cam being shaped to depress the actuating element against the ramp and thereby deflect the finger element to engage the contact.

4. A waterproof watch according to claim 2, and including a common conductive ground plane attached to said module, said finger elements extending from said ground plane.

5. A waterproof watch according to claim 2, wherein said cover and said case have a resilient sealing O-ring therebetween, said cover having an inner surface spaced from said case for limited depression of the cover.

6. A waterproof watch according to claim 5, and including an actuating element bearing against each of said finger elements, said cam having a face portion for engagement with a selected one of said actuating elements to move the associated finger element partially toward the adjacent contact and to complete movement of the finger element when said cover is depressed.

7. A waterproof watch according to claim 1, wherein said indexing means includes a plurality of circumferentially spaced sockets in said cover, and a detent in said case biased to seat in said sockets;

a shallow channel interconnecting said sockets, said detent having a range of deflection sufficient only to ride in said channel between the sockets.

8. A waterproof watch according to claim 7, wherein the trnsparent portion of said cover reveals said indexing means.

9. A waterproof watch according to claim 3, wherein said cover has limited freedom of axial movement on said case;

said cam having a face portion for engagement with a specific one of said actuating elements at a particular indexed position of the cover, to depress that actuating element partially and deflect the associated finger element partially toward the contact, the switch closing action being completed by axial depression of the cover.

10. A waterproof watch according to claim 1, and including a back plate removably mounted and sealed in said case.

* * * * *